US009231354B1

(12) United States Patent
Spinner et al.

(10) Patent No.: US 9,231,354 B1
(45) Date of Patent: Jan. 5, 2016

(54) INTERCONNECTIONS FOR AXIAL CABLES

(71) Applicants: Advanced Testing Technologies, Inc., Hauppauge, NY (US); Eli Levi, Dix Hills, NY (US)

(72) Inventors: Robert Spinner, East Northport, NY (US); Eli Levi, Dix Hills, NY (US); Richard Engel, Ridge, NY (US); Thomas Leddy, Eastport, NY (US)

(73) Assignee: Advanced Testing Technologies, Inc., Hauppauge, NY (US)

( * ) Notice: Subject to any disclaimer, the term of this patent is extended or adjusted under 35 U.S.C. 154(b) by 0 days.

(21) Appl. No.: 14/475,704

(22) Filed: Sep. 3, 2014

(51) Int. Cl.

| | |
|---|---|
| ***H01R 9/05*** | (2006.01) |
| ***H01R 24/40*** | (2011.01) |
| ***H01R 24/28*** | (2011.01) |
| ***H01R 4/48*** | (2006.01) |
| ***H01R 13/629*** | (2006.01) |

(52) U.S. Cl.
CPC ..... *H01R 24/40* (2013.01); *H01R 4/489* (2013.01); *H01R 13/629* (2013.01); *H01R 24/28* (2013.01)

(58) Field of Classification Search
CPC ..... H01R 9/05; H01R 9/0518; H01R 24/38; H01R 24/52
See application file for complete search history.

(56) References Cited

U.S. PATENT DOCUMENTS

| | | | | |
|---|---|---|---|---|
| 4,290,663 | A * | 9/1981 | Fowler et al. | 439/607.52 |
| 4,836,791 | A | 6/1989 | Grabbe et al. | |
| 5,462,445 | A | 10/1995 | Anhalt | |
| 5,775,934 | A | 7/1998 | McCarthy | |
| 7,001,220 | B2 * | 2/2006 | Thorner et al. | 439/675 |
| 7,942,695 | B1 | 5/2011 | Lu | |
| 8,083,544 | B2 | 12/2011 | Chee | |
| 8,262,408 | B1 | 9/2012 | Kelly | |
| 8,496,502 | B2 | 7/2013 | Orner | |
| 8,628,352 | B2 | 1/2014 | Nugent | |

* cited by examiner

*Primary Examiner* — Xuong Chung Trans
(74) *Attorney, Agent, or Firm* — Brian Roffe

(57) ABSTRACT

Cable interconnection terminated by a pin or socket includes a housing, an inner conductor arranged in the housing and having a first end adapted to couple to the pin or socket, and an outer sheath adapted to couple to an outer sheath of a cable including at least one conductor, e.g., a coaxial cable, twin-axial cable or tri-axial cable. The interconnection also includes first and second pins. The first pin is arranged at a second end of the inner conductor while the second pin is electrically connected to the outer sheath. The first and second pins each have a mating portion, and both mating portions terminate at a common plane a set distance from the housing. This termination in a common plane, substantially perpendicular to the axial direction of the pins, enables the cable to mate with a wide range of electronic componentry.

20 Claims, 4 Drawing Sheets

INTERCONNECTIONS FOR AXIAL CABLES

FIELD OF THE INVENTION

The present invention relates generally to terminations for mating a coaxial contact to a discrete header style contact system on, for example, a test station.

BACKGROUND OF THE INVENTION

Patch panels or mass interconnect systems are typically utilized within test stations to permit easy connection and disconnection of a plurality of discrete analog, digital, power, fiber optic (FO) and radio frequency (RF) signals. Coaxial cables are generally used where wide bandwidth and shielding are required. More often than not, coaxial contacts for use within a patch panel are tailored for a select cable group or even a single specific type of coaxial cable. Users that require a different termination style on the mating side of the patch panel are left with few options to utilize different coaxial cables or transition to a different termination style. Current solutions that offer alternative termination options utilize termination styles that are not conducive to mating with industry standard 0.100" pitch spacing and have asymmetrical pin lengths relative to the body of the contact.

One solution that provides an alternative termination for a coaxial cable is sold by Virginia Panel Corporation, designated product no, 61014140. This coax assembly 100 is shown in FIG. 4 and includes an inner conductor 102 having a first end 104 that receives the center pin of a coaxial cable and a second end 106 defining a first, elongate contact. An intermediate sheath 108 surrounds the inner conductor 102, except for a contact portion of the first, elongate contact defined at the second end 106. The shield of the coaxial cable engages with an outer sheath 110 that is electrically connected to a second, elongate contact 112. The first and second contacts are axially separated from one another by a distance of about 0.08 inches from center to center, but their axial ends are spaced apart from one another such that they cannot engage with a co-planar set of mating contacts.

OBJECTS AND SUMMARY OF THE INVENTION

An object of at least one embodiment of the present invention is to adapt a coaxial patch panel termination to a 0.100" header style termination with 0.025" square or round pins to allow a broader range of interconnect options.

To achieve this object, and possibly others, a cable interconnection terminated by a pin or socket in accordance with the invention includes a housing, an inner conductor at least partly arranged in the housing and having a first end adapted to couple to the pin or socket terminating a cable including at least one axial conductor (e.g., a coaxial, twin-axial or tri-axial cable) and a second end, and an outer sheath adapted to couple to an outer sheath of the cable. The interconnection also includes first and second pins. The first pin is arranged at a second end of the inner conductor while the second pin is electrically connected to the outer sheath. The first and second pins each have a mating portion, and both mating portions terminate at a common plane a set distance from the housing. This termination in a common plane, substantially perpendicular to the axial direction of the pins, enables the cable to mate with a wide range of electronic componentry.

In some embodiments, the first pin may be integral with the inner conductor. The mating portions of the first and second pins are spaced apart a distance of about 0.100 inches from another. The first and second pins may be round pins and the mating portions of the first and second pins have a diameter of about 0.025 inches. Alternatively, the first and second pins may be square pins and the mating portions of the first and second pins have a side of about 0.025 inches. The first and second pins extend from a common plane at a rear of the housing, this plane being parallel to the plane in which the ends of the pins are situated, and also substantially perpendicular to the axial direction of the pins. The first and second pins each have an angled portion between the mating portion and the housing that changes an axial direction of the pin, i.e., provides the pins with an axial offset. Electrical insulating material may be arranged in the housing between the inner conductor and the outer sheath. A spring retaining clip may be provided to retain the housing in a module.

A module in accordance with the invention includes a plurality of interconnections as described above. An indexing ridge may be arranged on each interconnection to provide alignment of the interconnections within the module.

The invention will be described in detail with reference to some preferred embodiments of the invention illustrated in the figures in the accompanying drawings. However, the invention is not confined to the illustrated and described embodiments alone.

BRIEF DESCRIPTION OF THE DRAWINGS

Additional objects of the invention will be apparent from the following description of the preferred embodiment thereof taken in conjunction with the accompanying non-limiting drawings, in which.

DETAILED DESCRIPTION OF THE INVENTION

Figure 1:
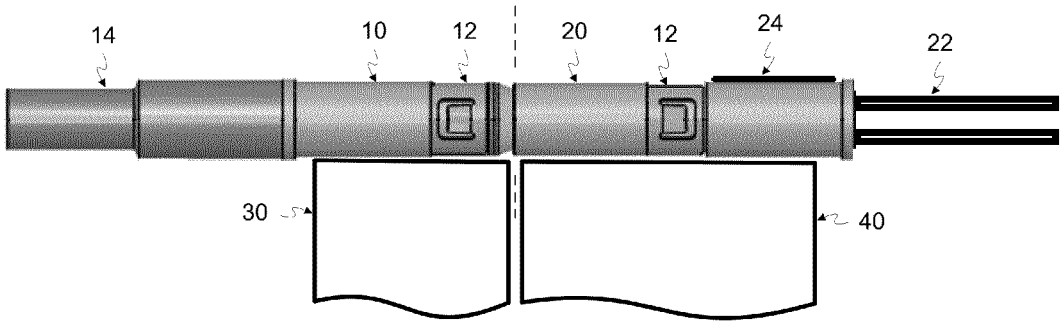
FIG. 1 shows a side view of solder style pin contact mated with a header style socket contact in accordance with the invention.

Carefully selected pieces of automatic test equipment (ATE) that are implemented in benchtop or transportable platforms form powerful test stations that are reconfigurable through the use of patch panels for interconnection. The patch panel interconnection allows mass connection and disconnection of discrete analog, digital, power, fiber optic (FO) and radio frequency (RF) signals. Connectors that utilize 0.100" on-center pin spacing have been in use for decades and are commonly used for discrete analog and digital signals. Coaxial, twin-axial and tri-axial cabling is typically used for signals requiring low insertion loss, controlled impedance and shielding. For certain applications, it would be desirable to utilize the 0.100" header style termination for a coaxial, twin-axial or tri-axial signal in lieu of the standard solder or crimp style termination.

The current invention permits the use of a 0.100" header style termination in conjunction with a coaxial, twin-axial or tri-axial style contact. Preferred embodiments of the invention will be described with reference to FIGS. 1 and 2 wherein like reference numerals refer to the same or similar elements.

Patch panel contacts are typically configured in a socket and pin arrangement where the socket contact normally is used on the equipment side of the patch panel and the pin contact is used on the test side of the patch panel. Other variations of contacts are implemented in a sexless manner whereby the contact mates with the same style contact and is used on both the equipment and test sides of the patch panel.

FIG. 1 shows a side view of a pin contact 10 mated to a socket contact 20 in accordance with the invention. In this embodiment, the socket contact 20 includes a unique header configuration in accordance with the invention, while the pin contact 10 provides the termination for a coaxial cable. The reverse is also considered the invention, i.e., pin contact 10 is provided with the header configuration in accordance with the invention while the socket contact is used to terminate the coaxial cable. Indeed, it is also possible that the coaxial cable termination is neither a pin or socket style termination, but another type of coaxial cable termination, e.g., a sexless contact. Its mating contact would then be the component of a coaxial cable terminating assembly in accordance with the invention that includes the unique header configuration in accordance with the invention. One skilled in the art would recognize the manner in which to implement the unique header configuration for a sexless contact in view of the disclosure herein.

A plurality of contacts is typically installed within a module 30 (containing a plurality of pin contacts in this example) or module 40 (containing a plurality of socket contacts in this example) which permits for mass connection when engaged (mated). In cases where a sexless contact is implemented or where the pin contact and socket contact have compatible geometries, modules 30 and 40 could be populated with the same part. For modules that contain signal carrying contacts, this module is typically constructed from some form of insulating material, such as a polymer-based plastic. Additional details about such modules, and how to form such modules from pin contacts or socket contacts, or sexless contacts, are known to those skilled in the art to which this invention pertains, and would be readily apparent for use in the invention in view of the disclosure herein. One skilled in the art could therefore construct modules 30 and module 40 using their knowledge and the disclosure herein.

A respective spring retaining clip 12 allows each of the pin and socket contacts 10, 20 to remain firmly mounted within the respective module housing 30, 40, during engagement/disengagement cycles. The spring retaining clip 12 is typically constructed from beryllium copper for its spring-like properties and plated with a thin layer of nickel for corrosion resistance. In a preferred embodiment, a separate extraction tool may be used to compress the spring retaining clips 12 of a contact 10, 20 after mounting within the respective module 30, 40 to allow for removal of the contact from the module. Instead of spring retaining clips 12, other means or mechanism to mount the pin and socket contacts 10, 20 within the respective module housing 30, 40 may be used in the invention, and different mounting means and mechanism may be used for the pin and socket contacts 10, 20 and within the same housing 30, 40. Such means and mechanism are known to those skilled in the art to which this invention pertains, and such means and mechanisms are considered for possible use in the invention.

Other types of patch panel modules may support functions such as vacuum or pneumatic applications which can be interspersed among different types of signal carrying modules. The manner in which these functions may be incorporated into the invention would be readily apparent to those skilled in the art to which this invention pertains in view of the disclosure herein.

Typical coaxial contacts have either a solder cup or crimp style termination 14 as a means for securing the pin contact 10, to the coaxial, twin-axial or tri-axial cable 8. Such cables will be referred to as a cable with at least one conductor. The termination 14 is situated over the coaxial cable 8 and may be considered part of the coaxial cable 8. The coaxial cable 8 is typically stripped such that the overall jacket (sheath) is removed, exposing the shield (can be a braid, foil or both), the inner dielectric and the center conductor (see FIG. 3). The center contact pin (typically supplied loose) is either crimped or soldered onto the center conductor, or otherwise brought into electrical contact therewith. The stripped cable, with the center conductor contact attached, is then inserted into the body of the coaxial contact. The contact body is then crimped over the cable. Each contact is different such that some crimp over the shield portion, some crimp over the overall jacket, and some get crimped twice, once over the shield portion and once over the jacket.

This style of termination may optionally include a ferrule (not shown) for fastening and reinforcing the connection of the coaxial cable 8 to the body of the pin contact 10. The ferrule would be inserted onto the coaxial cable after the contact pin is electrically engaged with the center conductor and before the contact body is crimped over the cable. The ferrule can thus be slid over the braid and crimped with a crimping tool. Similarly, the other crimpings mentioned herein may be performed with a crimping tool known to those skilled in the art to which this invention pertains.

The body of the pin contact 10 is generally cylindrical in nature and typically constructed from brass, and plated with nickel for corrosion resistance and gold to improve its electrical properties. The pin contact 10 includes a tubular outer shield or sheath 44, a tubular form of insulating material 16 inward of the outer shield or sheath 44, and a center conductor 42 inward of the insulating material 16 (see FIG. 2). The spring retaining clips 12 engage with the outer shield or sheath 44. Center conductor 42 includes the structure for mating to a contact of the coaxial cable 8, e.g., a receptacle or socket for mating to the center conductor of the coaxial cable 8.

The socket contact 20 is shown with 0.025" square header style pins 22 that are typically associated with about 0.100" pin spacing. Pins 22 are dimensioned to terminate at ends that lie in a common plane a set distance from the housing of the socket contact 20. The common plane may be substantially parallel to the rear edge of the housing of the socket contact 20. The rear edge of the housing of the socket contact 20 may be planar, i.e., lie generally in a single vertical plane relative to the orientation shown in FIGS. 1 and 2. Thus, the pins 22 would terminate at ends that lie in the same vertical plane a set distance from the rear planar edge of the housing of the socket contact 20. This allows the socket contact 20 to be engaged with mating contacts in a common plane. To achieve this, an inner conductor 28 at least partly arranged in the housing of the socket contact 20 has an aperture 32 at one end for receiving a pin of the pin contact 10 that terminates the coaxial cable 8, and terminates in an about 0.025" square header style pin, 22 at the opposing end of the inner conductor 28 (see FIG. 2). The inner conductor 28 may be an integral unit or assembly with a central one of the pins 22. Alternatively, the end of the inner conductor 28 would include a pin that enters into a socket of the coaxial cable termination.

It should be understood that the termination of the ends of the pins 22 in a common plane is the intended and preferred embodiment of the invention, but it is recognized there may be slight deviations in the commonality of this termination plane that arise, for example, from manufacturing conditions. Such deviations are unlikely to affect the ability to terminate the pins 22 to the mating contacts in the common plane. Moreover, in the illustrated embodiment, it should be noted that the termination plane is perpendicular to the longitudinal axis of the socket contact 20. Thus, both pins 22 extend longitudinally a set, and the same distance, from the rear edge of the housing of the socket contact 20.

The other, outer pin 22 is connected to an outer sheath 36 of the socket contact 20. An electrical insulation component or member 38 is situated in the housing of the socket contact 20 between the inner conductor 28 and the outer sheath 36. The housing of the socket contact 20 therefore includes, from the outermost component inward, an outer sheath 36, insulation component or member 38 or other electrical insulating material, and inner conductor 28. Optionally, an indexing ridge 24 described below is situated on the outer surface of the outer sheath 36.

An alternate embodiment may utilize about 0.025" diameter round pins in lieu of the square pin. In order to maintain spacing and form/fit with existing modules, the about 0.025" pins must be formed in such a way to introduce an offset such that both pins 22 are approximately centered along the bore of the contact 20. That is, the pins 22 are each spaced apart from the center axis extending between the pin and socket contacts 10, 20 an equal distance. The header style pins 22 permit interfacing with cabling systems that adapt a single header pair of pins 22 to coaxial cabling. These cabling systems also employ carriers which permit a plurality of the header pairs to be grouped as a single connector to facilitate better cable management. The header style pins 22 also permit connection via wire wrap methods or even connection to a printed circuit board (PCB).

Regardless of which style pins 22 are used, it is important that at least a mating portion of each pin 22 has the designed shape and dimension, i.e., the entire pin is not necessary round or square but only a mating portion thereof that is needed for the pins 22 to mate with the cabling system. Each pin 22 also includes a bent or angled portion that changes the plane from which the pins 22 extend from the contact 20, i.e., between the mating portion of the pins 22 and the housing of the socket contact 20. The central one of the pins 22 extends from an approximately central location of the socket contact 20 and then is angled by the angled portion upward and then returns to a plane substantially parallel to the socket contact 20 (see FIG. 3). Similarly, the outer one of the pins 22 extends from an outer region of the socket contact 20 and then is angled by the angled portion upward and then returns to a plane substantially parallel to the socket contact 20 (see FIG. 3). The mating portions of the pins 22 are therefore substantially parallel to one another, i.e., rearward of the angled portions. The mating portions 22 are thus spaced apart from one another a predetermined distance, the purpose of which is explained below.

Figure 3:
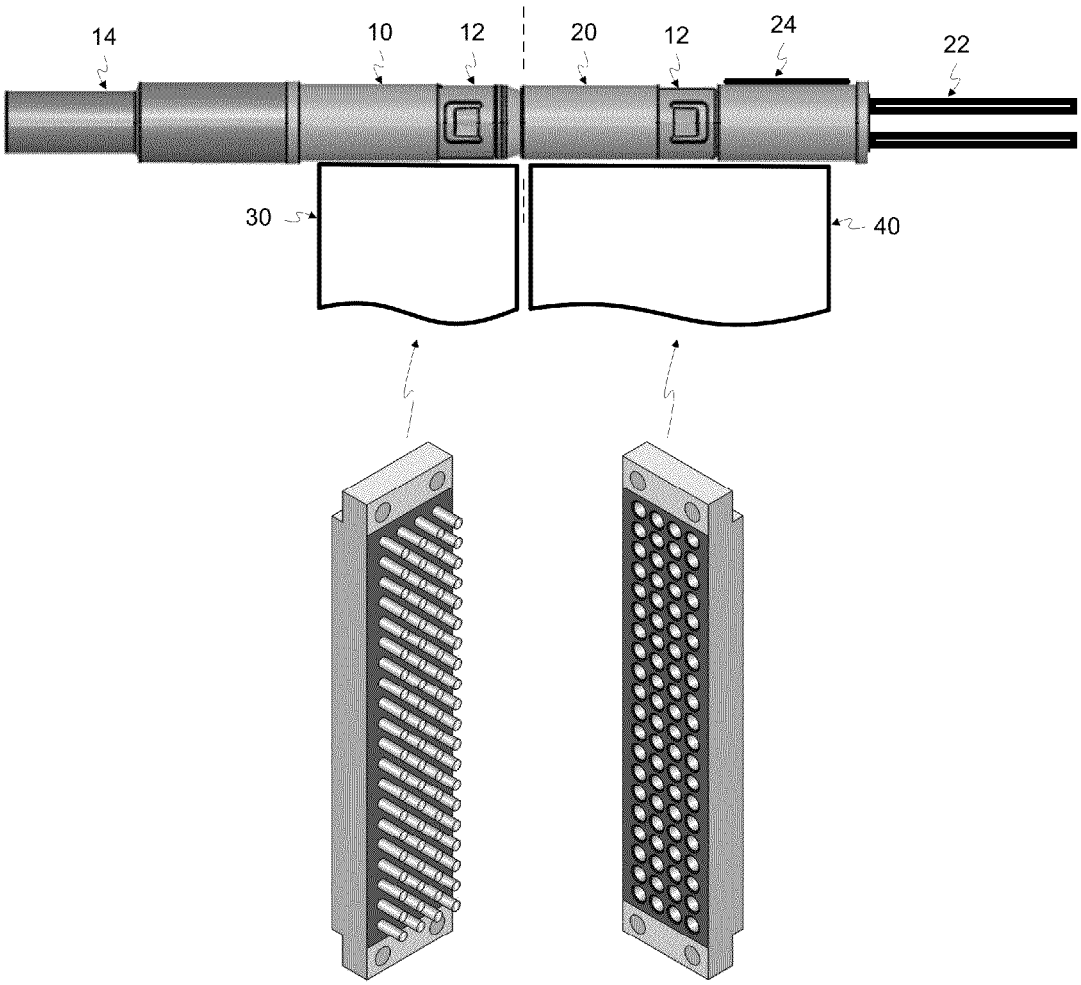
FIG. 3 is a view showing the front faces of modules that each retain several of the pin contacts and socket contacts of the invention.
Figure 4:
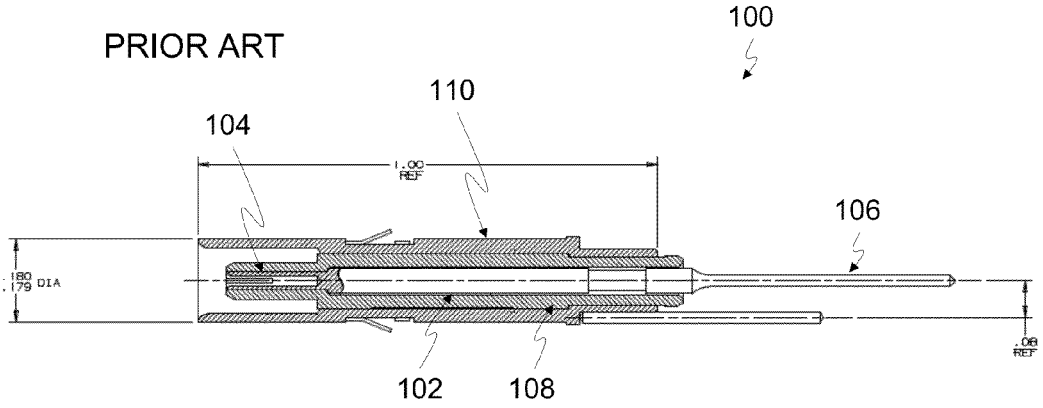
FIG. 4 is a cross-section of a prior art coax assembly.

The pins 22 also preferably have symmetric pin lengths relative to the contact body, i.e., they terminate in a common vertical plane when viewed as shown in FIG. 3. This common vertical plane is substantially perpendicular to the axial direction of the pins. As a result of this termination, the pins 22 will generally also have a common length, i.e., both extend from the rear surface of the housing of the socket contact 20 the same distance. However, the pins 22 also start in a common plane, i.e., the plane at the rear of the housing of the socket contact 20.

In a preferred embodiment the header style socket contact 20 is equipped with an indexing ridge 24 which allows for coherent alignment of all contacts within a module 40 (see FIG. 3). It should also be noted that the about 0.100" header style pins can be implemented in pin, socket or sexless types of coaxial contacts.

Figure 2:
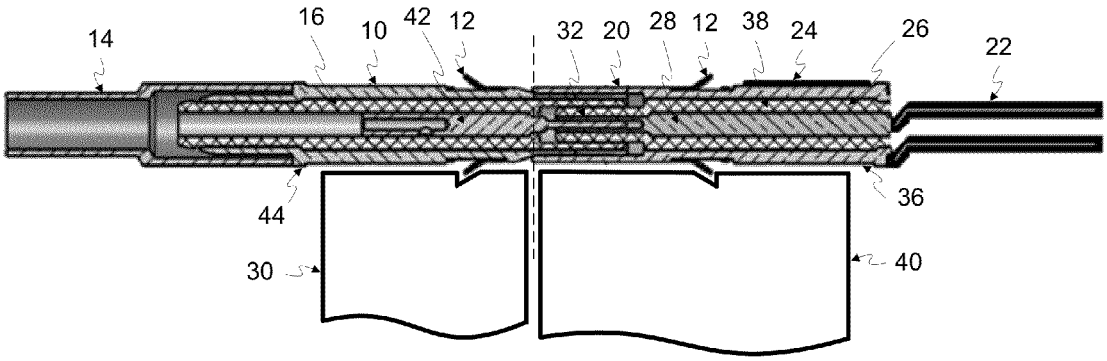
FIG. 2 reflects a cross sectional view of the mated contacts shown in FIG. 1.

FIG. 2 shows a cross-sectional view of the mated pin contact 10 and socket contact 20 and shows the spring retainer clip 12 mounting within the modules 30, 40 in greater detail. A dielectric insulating material 16 (in pin contact 10) or 26 (in socket contact 20), is typically constructed from polytetrafluoroethylene (PTFE, more commonly known by the trademark name, TEFLON®) supports the center conductor 42, 28 of the coaxial contact 10, 20, respectively, while insulating it from the surrounding body (shield or outer sheaths 44, 36). Each center conductor 42, 28 is typically constructed from the same material as the body, in this case, brass with gold over nickel plating.

The geometries of the contact are such that the characteristic impedance of the coaxial contact is nominally 50 ohms which are common to RF applications.

Alternate embodiments may include geometries that result in a nominal 75 ohm characteristic impedance for video applications, or others still for twin-axial, tri-axial and custom applications.

In summary, the invention provides a termination for a coaxial contact, whether a pin contact or a socket contact, to a header style contact system adapted to mate with a pair of pins spaced apart from one another by a distance of, preferably, about 0.100 inches. The header configuration provides this pin spacing, i.e., pins 22. Pins 22 preferably have a diameter when round or side when square of about 0.025 inches. Similar contacts to coaxial contacts are known for twin-axial and tri-axial cables, and the invention is equally applicable to such contacts as well.

Having thus described a few particular embodiments of the invention, various alterations, modifications, and improvements will readily occur to those skilled in the art. Such alterations, modifications and improvements as are made obvious by this disclosure are intended to be part of this description though not expressly stated herein, and are intended to be within the spirit and scope of the invention. Accordingly, the foregoing description is by way of example only, and is not limiting. The invention is limited only as defined in the claims and equivalents thereto.

The invention claimed is:

1. An interconnection terminated by an electrical contact that enables the interconnection to mate with an electronic component receivable of a 0.1 inch header termination, comprising:

a housing;

an inner conductor at least partly arranged in said housing and having a first end adapted to couple to an electrical contact and a second end;

an outer sheath around said inner conductor;

electrical insulating material arranged in said housing between said inner conductor and said outer sheath; and first and second elongate pins, said first pin being arranged at said second end of said inner conductor, said second pin being electrically connected to said outer sheath, said first and second pins each having a mating portion having a uniform cross-sectional shape, said mating portions being parallel to one another, said mating portion of said first pin being spaced apart from said mating portion of said second pin such that a distance between a center of said mating portion of said first pin and a center of said mating portion of said second pin is 0.1 inch, and said mating portions both terminating at a common termination plane that is a set and the same distance from said housing such that the interconnection terminated by the electrical contact is configured to mate with an electronic component receivable of a 0.1 inch header termination.

2. The interconnection of claim 1, wherein said first and second pins extend from a common extension plane at a rear of said housing that is parallel to the common termination plane.

3. The interconnection of claim 1, wherein said first and second pins each have an angled portion between said mating portion and said housing that changes an axial direction of said pin.

4. The interconnection of claim 1, wherein said common termination plane is perpendicular to a longitudinal axis of said mating portion of each of said pins.

5. The interconnection of claim 1, wherein said common termination plane is perpendicular to a longitudinal axis of said housing.

6. The interconnection of claim 1, wherein said first and second pins have the same length outside of said housing.

7. The interconnection of claim 1, wherein said first pin is integral with said inner conductor.

8. The interconnection of claim 1, wherein said mating portions of said first and second pins are spaced apart from a center axis of said housing an equal distance.

9. The interconnection of claim 1, wherein the uniform cross-sectional shape of said mating portions of said first and second pins is circular and said circular mating portions of said first and second pins have a diameter of about 0.025 inches.

10. The interconnection of claim 1, wherein the uniform cross-sectional shape of said mating portions of said first and second pins is square and said square mating portions of said first and second pins have a side of about 0.025 inches.

11. The interconnection of claim 1, wherein said first end of said inner conductor defines a socket adapted to receive a pin which is the electrical contact.

12. The interconnection of claim 1, further comprising a spring retaining clip for retaining said housing in a module.

13. A module comprising a module housing and a plurality of interconnections of claim 1 arranged in said module housing and oriented in a common direction to provide coaxial receptacles on a first side of said module housing and said first and second pins of each of said interconnections on a second side of said module housing.

14. The module of claim 13, further comprising an indexing ridge arranged on each of said interconnections and adapted to provide alignment of said interconnections within said module housing.

15. The interconnection of claim 1, wherein said first pin extends from an approximately central location of said housing and then is angled upward and then angled to a plane substantially parallel to an axis of said housing, and said second pin extends from an outer region of said housing and then is angled upward and then angled to a plane substantially parallel to the axis of said housing.

16. An interconnection terminated by an electrical contact that enables the interconnection to mate with an electronic component receivable of a 0.1 inch header termination, comprising:

a housing;

an inner conductor at least partly arranged in said housing and having a first end adapted to couple to an electrical contact and a second end;

an outer sheath around said inner conductor;

electrical insulating material arranged in said housing between said inner conductor and said outer sheath; and first and second elongate pins, said first pin being arranged at said second end of said inner conductor, said second pin being electrically connected to said outer sheath, said first and second pins each having a mating portion and an angled portion between said mating portion and said housing that changes an axial direction of said pin such that said mating portions of said first and second pins are spaced apart from a center axis of said housing an equal distance, said mating portion and said angled portion being exterior of said housing, said mating portions being parallel to one another, said mating portion of said first pin being spaced apart from said mating portion of said second pin such that a distance between a center of said mating portion of said first pin and a center of said mating portion of said second pin is 0.1 inch, and said mating portions both terminating at a common termination plane that is a set and the same distance from said housing such that the interconnection terminated by the electrical contact is configured to mate with an electronic component receivable of a 0.1 inch header termination.

17. The interconnection of claim 16, wherein said first and second pins extend from a common extension plane at a rear of said housing that is parallel to the common termination plane.

18. The interconnection of claim 16, wherein said common termination plane is perpendicular to a longitudinal axis of said mating portion of each of said pins or perpendicular to a longitudinal axis of said housing.

19. The interconnection of claim 16, wherein said first and second pins have a uniform cross-sectional shape and the same length outside of said housing.

20. A module comprising a module housing and a plurality of interconnections of claim 16 arranged in said module housing and oriented in a common direction to provide coaxial receptacles on a first side of said module housing and said first and second pins of each of said interconnections on a second side of said module housing.

* * * * *